United States Patent [19]

Burke

[11] 4,357,556

[45] Nov. 2, 1982

[54] TELEVISION DISPLAY SYSTEM EMPLOYING PERMEABLE CORRECTORS FOR A DEFLECTION YOKE

[75] Inventor: Thomas P. Burke, Millersville, Pa.

[73] Assignee: RCA Corporation, New York, N.Y.

[21] Appl. No.: 196,204

[22] Filed: Oct. 14, 1980

[51] Int. Cl.[3] ..... H01J 29/76; H01F 3/12

[52] U.S. Cl. ..... 313/440; 335/211

[58] Field of Search ..... 313/440; 335/211

[56] References Cited

U.S. PATENT DOCUMENTS

| | | | |
|---|---|---|---|
| 3,020,434 | 2/1962 | Bloomsburgh | 313/440 |
| 4,257,023 | 3/1981 | Kamijo | 335/210 X |
| 4,305,055 | 12/1981 | Marrett, Jr. | 335/211 |
| 4,307,363 | 12/1981 | McGlashan | 335/211 |
| 4,335,366 | 6/1982 | Alig et al. | 335/211 |

FOREIGN PATENT DOCUMENTS

| | | | |
|---|---|---|---|
| 55-121255 | 9/1980 | Japan | 313/440 |
| 2010005 | 6/1979 | United Kingdom . | |
| 2013972 | 8/1979 | United Kingdom . | |

*Primary Examiner*—Palmer C. Demeo

*Attorney, Agent, or Firm*—Paul J. Rasmussen; William H. Meagher; Scott J. Stevens

[57] ABSTRACT

A correction apparatus for a deflection yoke for use with a color television kinescope comprises a plurality of magnetically permeable rods disposed at the rear of the yoke. Each of the rods comprises a short portion disposed parallel to the neck of the kinescope and an elongated portion disposed perpendicular to the neck of the kinescope. The elongated portions of the rods are positioned within the external field of the vertical deflection coils. Flux from the external field is channeled into the rods to form a magnetic field between the short portions of corresponding members on opposite sides of the tube neck to provide vertical coma correction. The vertical dimension of the rods is a small fraction of the diameter of the kinescope neck in order that the high permeable path presented to the external horizontal field by the rods does not appreciably distort the external horizontal field.

9 Claims, 5 Drawing Figures

TELEVISION DISPLAY SYSTEM EMPLOYING PERMEABLE CORRECTORS FOR A DEFLECTION YOKE

This invention relates to television display systems, and in particular, to television display systems incorporating self-converging deflection yokes which employ magnetically permeable members to form error correcting auxiliary fields.

Color television receivers of recent years have increasingly been manufactured with picture tubes having electron gun assemblies which produce horizontally aligned electron beam for use with self-converging deflection yokes which can substantially converge the three electron beams at all points on the picture tube display screen without the need for dynamic convergence circuitry. Such self-converging deflection yokes comprise horizontal deflection coils which produce a negative isotropic astigmatism and vertical deflection coils which produce a positive isotropic astigmatism. It is known that negative isotropic astigmatism is produced by deflection coils having a net overall pincushion-shaped nonuniformity and positive isotropic astigmatism is produced by deflection coils having a net overall barrel-shaped nonuniformity.

Although the correct net overall nonuniformity must be achieved by the deflection yoke to generally realize overall convergence of the beams, localized variations in the deflection field nonuniformity may be necessary to correct residual errors, such as coma error and pincushion raster distortions. For example, third order aberration analysis reveals that a pincushion-shaped nonuniformity in the vertical deflection field in the vicinity of the exit end of the yoke is effective to correct side pincushion distortion. A pincushion-shaped nonuniformity in the vertical deflection field in the vicinity of the entrance end of the yoke is effective to correct vertical coma where the height of the center beam raster is less than the height of the outer beam rasters. It is obvious that the pincushion-shaped nonuniformity needed for coma and side pincushion distortion correction is in conflict with the barrel-shaped nonuniformity needed for beam convergence. The only requirement, however, is that the net overall nonuniformity be barrel-shaped, and it is possible to have localized pincushion-shaped field nonuniformities for coma and side pincushion correction while still maintaining an overall barrel-shaped nonuniformity necessary for convergence.

Providing a deflection field with the desired nonuniformity is not easily accomplished. It is possible to configure the deflection coils by using non-radial winding techniques to provide the necessary corrections while still maintaining convergence, but this requires specialized apparatus and may result in a yoke whose convergence is extremely sensitive to transverse motion on the tube neck. An alternate technique uses external field modifying pieces to correct either vertical coma or side pincushion distortion. The uncorrected coma or pincushion distortion may be corrected using non-radial winding techniques or other means. The use of external pieces is shown in British Patent Application No. 2,010,005, which uses field formers at the front of the yoke for correction of side pincushion distortion.

It is also known to use field formers at the rear of the yoke to correct coma errors of the type where the height of the center beam raster is less than the height of the outer beam rasters. British Patent Application No. 2,013,972 discloses the use of field formers located in the main vertical deflection field in order to distort the field to correct coma. The field formers are made of a high permeability material which presents a low reluctance path to the deflection field flux. The use of coma correcting field formers located outside the yoke to channel external flux from the vertical coils to the rear of the yoke is shown in U.S. Patent Applications Ser. Nos. 149,681; 162,594; and 164,344, all assigned to the present assignee.

If the vertical dimension of the field formers becomes an appreciable fraction of the diameter of the kinescope neck, sufficient horizontal flux from the horizontal external field may be channeled into the field formers to distort the horizontal external field such that misconvergence of the beams may result (e.g. in the corners). The present invention provides a means for correcting coma errors while presenting a path for horizontal deflection flux which does not contribute to any significant distortion of the horizontal external field.

In accordance with the invention, there is provided a color television display system comprising a kinescope incorporating a display screen and a neck having an electron gun assembly within the neck for producing three horizontal in-line electron beams. A deflection yoke comprising a magnetically permeable core and horizontal and vertical coils each having a main deflection field and an external field provides deflection of the electron beams to produce rasters on the display screen.

First and second field forming means are disposed at the rear of the yoke on opposite sides of the vertical axis through the kinescope neck. Each of the field forming means comprises a first magnetically permeable member disposed above the horizontal axis through the neck. A second magnetically permeable member is disposed below the horizontal axis. Each of the members comprises an elongated first portion disposed perpendicular to the neck and extending outwardly therefrom at least to the outer perimeter of the rear of the core and a second portion parallel to the kinescope neck. The vertical dimension of the members is a small fraction of the diameter of the kinescope neck. The members are located within the horizontal and vertical coil external fields. Flux from the vertical external field is channeled into the members where a coma-correcting magnetic field is formed between corresponding second portions of the first and second field forming means.

In the accompanying drawings, FIG. 1 is a representation of television rasters illustrating a condition of vertical coma;

Figure 1:
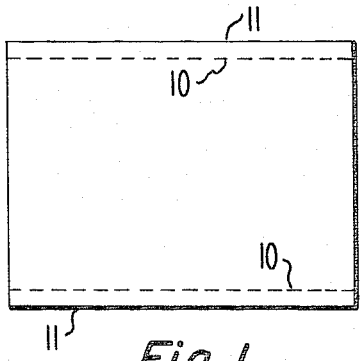

The barrel-shaped vertical deflection field needed for convergence of the electron beams in self-converging yoke-kinescope arrangements causes a greater vertical deflection of the outer electron beams than the central beam. This results in a condition of vertical coma of the type where the center beam raster is reduced in height with respect to the height of the outer beam rasters. This type of coma is illustrated in FIG. 1, in which the center beam raster is designated by dashed lined 10 and the outer beam rasters are designated by solid lines 11. In order to correct coma errors of this type, it is necessary to increase the vertical deflection of the center beam and/or decrease the vertical deflection of the outer beams. Magnetic shunts and enhancers have been used in the electron gun assembly of the kinescope to correct some of the coma, but this method, in addition to adding cost and complexity to the kinescope manufacturing process, is often insufficient to correct coma completely. It is often necessary to use external field formers or modifiers either in addition to internal devices or as a sole means of coma correction.

Figure 2:
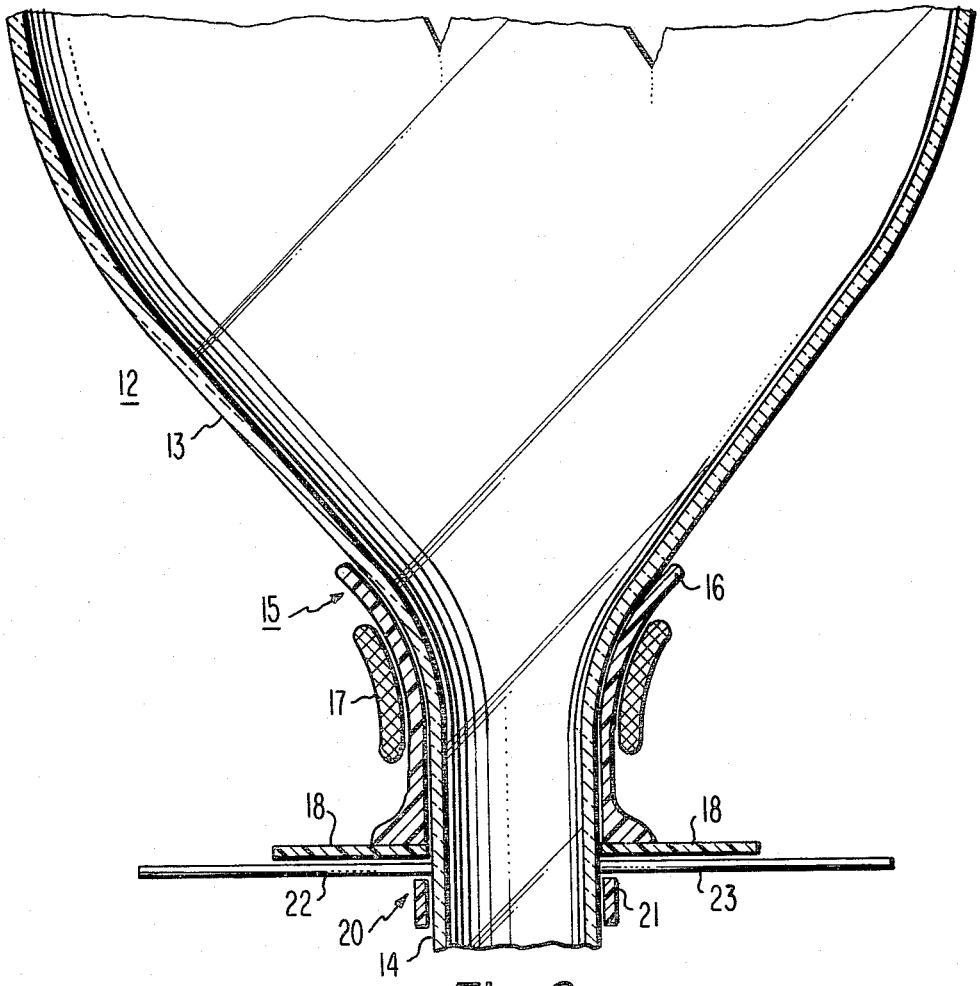
FIG. 2 is a top cross-sectional view of a color television display system constructed in accordance with the present invention.

Referring to FIG. 2, there is shown a television display system incorporating an external field forming device for correcting vertical coma errors. The display system comprises a kinescope 12 incorporating a funnel region 13 and a neck region 14. A phosphor display screen (not shown) is located at the end of the kinescope opposite the neck region 14. An electron gun assembly (not shown), located within neck region 14, produces three in-line electron beams which illuminate the display screen.

A deflection yoke 15 is located on the kinescope 12 in the vicinity where funnel region 13 and neck region 14 are joined. Deflection yoke 15 comprises a pair of saddle-type horizontal deflection coils (not shown) located adjacent to kinescope 12. A plastic insulator 16, typically cone-shaped, surrounds the horizontal coils. Insulator 16 supports the horizontal coils and may incorporate ridges or channels to locate the coils to their correct position. A magnetically permeable annular core 17 is located around insulator 16. Core 17 may be broken into two parts to facilitate placement of core 17 around insulator 16. The vertical deflection coils (not shown) are toroidally wound about the core 17. The coils are wound around each half of the core prior to assembly of the core 17 around insulator 16. A yoke mounting and adjustment plate 18 is mounted to insulator 16 at the rear of yoke 15.

A correction apparatus 20 is mounted to the neck 14 of kinescope 12 behind yoke 15. Correction apparatus 20 comprises a plurality of magnetically permeable rod-like members (rods 22 and 23 are shown in FIG. 2) secured within an annular holder 21.

Figure 3:
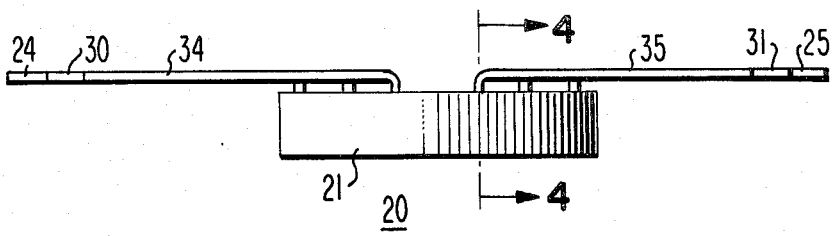
FIG. 3 is a top plan view of correction apparatus in accordance with the present invention.
Figure 4:
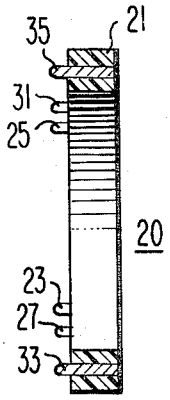
FIG. 4 is a side cross-sectional view of the correction apparatus shown in FIG. 3, taken along line 4—4.
Figure 5:
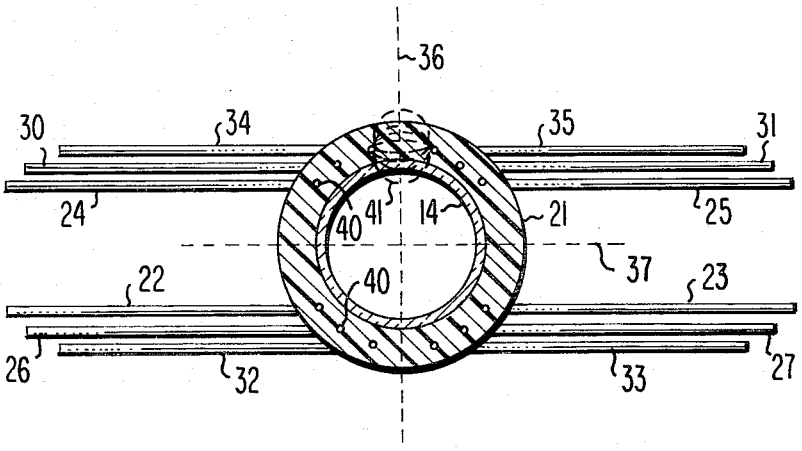
FIG. 5 is a rear cross-sectional view of the color television display system shown in FIG. 2.

Referring to FIGS. 3, 4 and 5, the construction and operation of correction apparatus 20 will be described in detail. In addition to rods 22 and 23, correction apparatus 20 comprises magnetically permeable rods 24, 25, 26, 27, 30, 31, 32, 33, 34 and 35 . Rods 22 and 23 are located on opposite sides of the kinescope vertical axis 36 and below the horizontal kinescope axis 37. Rods 24 and 25 are located on opposite sides of vertical axis 36 and above axis 37. Rods 26 and 32, and rods 27 and 33 are located on opposite sides of axis 36, respectively, and below horizontal axis 37. Rods 30 and 34, and rods 31 and 35 are located on opposite sides of axis 36, respectively, and above axis 37. Each of rods 22, 23, 24, 25, 26, 27, 30, 31, 32, 33, 34 and 35 has an elongated portion which extends substantially horizontally and a short portion disposed at right angles to the elongated portion and parallel to the kinescope neck. The short portions of each rod are secured by glue or other means within holes 40 in annular holder 21. FIG. 5 shows the correction apparatus 20 in cross-section looking along the longitudinal axis of the kinescope 12 toward the display screen end.

Correcting apparatus 20 is positioned on kinescope neck 14 at the rear of yoke 15 such that the elongated portions of rods 22, 23, 24, 25, 26, 27, 30, 31, 32, 33, 34 and 35 fall within the external spillover field of the toroidal vertical deflection coils. This causes a portion of the external magnetic field flux to be channeled into the elongated portions of the magnetically permeable rods. This channeled flux is carried through the elongated portion of the rods to the short portion of each rod. The flux present in each rod causes a magnetic field to be formed between the short portions of corresponding rods on opposite sides of vertical axis 36. That is, a field is formed between rods 34 and 35, 30 and 31, 24 and 25, 22 and 23, 26 and 27, and 32 and 33. Dashed lines 41 represent field lines of a field formed between rods 34 and 35. It can be seen that the field represented by lines 41 begins and ends at single sources and expands in the middle, forming a barrel-shaped field. Part of this barrel field falls outside the tube neck 14 and does not affect the beams, however. The portion of the field formed between rods 34 and 35 that falls within the tube cooperates with the field that falls within the tube formed between rods 32 and 33 to form a pincushion-shaped field within the tube neck 14. This pincushion-shaped field extends closer to the center electron beam than outer electron beams and hence has a greater effect on the center beam. The field causes a slight increase in vertical deflection of the center beam with respect to the outer beams, which provides a correction of vertical coma errors.

Similarly shaped fields are also formed between corresponding rods 30 and 31, 26 and 27, 24 and 25, and 22 and 23. Rods 30 and 31, and 26 and 27 have a greater separation than rods 34 and 35, and 32 and 33. Rods 24 and 25, and 22 and 23 have an even greater separation than the aforementioned combinations. The field between rods 22 and 23, for example, will be less strongly pincushion-shaped than the field between rods 26 and 27 which is less pincushion-shaped than the field between rods 32 and 33. The fields between rods 26 and 27, and 22 and 23, therefore, have respectively less effect on coma correction than the field between rods 32 and 33. Although rods 30, 31, 24, 25, 22, 23, 26 and 27 aid in overall coma correction, sufficient coma may be corrected by using only rods 32, 33, 34 and 35. The fields formed by rods 22, 23, 24, 25, 26, 27, 30 and 31, however, aid in reducing N-S pincushion distortion of the displayed raster.

The thickness or vertical dimension of the rods is a small fraction of the diameter of the kinescope neck with the difference being approximately an order of magnitude. The high permeable path through the field formers presented to the external horizontal field thereby, does not allow sufficient channeling of the external horizontal field flux into the rods to cause any significant distortion of the otherwise undistorted external horizontal field which could result in misconvergence of the electron beams.

It is possible to effect other corrections and conditions through the use of correction apparatus 20. By rotating apparatus 20 about the kinescope longitudinal axis, a change in height of one outer beam raster is effected with respect to the other outer beam raster. Changes in opposite directions are affected at the top and bottom. If apparatus 20 were constructed with the permeable members horizontally offset with respect to vertical axis 36, a change in height of one outer beam raster with respect to the other outer beam raster would be provided, with the change being in the same direction at the top and bottom.

An illustrative embodiment of a television display system embodying correction apparatus 20 incorporates a kinescope having a neck diameter of approximately 1.14 inches. The permeable rods are manufactured of wire having a diameter of approximately 0.0625 inches. The correction apparatus 20 is placed approximately 0.625 inches from the rear of the yoke core. The elongated portion of each rod is approximately 2.13 inches long, and the short portion is approximately 0.32 inches long. The vertical separation between rods is between 0.40 and 0.45 inches.

The elongated portion may be shortened to approximately the perimeter of the rear of the core without an appreciable reduction in effect, while increasing or decreasing the short portion will cause a respective increase or decrease in coma-correction. Decreasing the distance between corrector 20 and the yoke causes an increase in coma correcting effect.

The permeable members may also be constructed from strips of sheet steel, as long as the vertical dimension remains small.

An illustrative embodiment of the present invention has the correction apparatus 20 mounted on the kinescope neck independent of the yoke mounting. By mounting the correction apparatus on the tube neck rather than on yoke, the yoke may be rotated or otherwise adjusted without moving the correction apparatus, thus maintaining the relationship of the correction apparatus with respect to the electron beams.

What is claimed is:

1. A color television display system comprising:

a kinescope incorporating a display screen and a neck and having an electron gun assembly within said neck for producing three horizontal in-line electron beams;

a deflection yoke mounted on said kinescope neck and comprising a magnetically permeable core and horizontal and vertical deflection coils disposed adjacent said core, each of said coils producing a main deflection field and an external field, said yoke providing deflection of said electron beams for producing rasters on said display screen;

first and second field forming means disposed at the rear of the yoke on opposite sides of the vertical axis through said kinescope neck, said first and second field forming means each comprising an upper magnetically permeable member disposed above the horizontal axis through said kinescope neck and a lower magnetically permeable member disposed below the horizontal axis through said kinescope neck, each of said members consisting of an elongated first portion disposed substantially perpendicular to the longitudinal axis of said kinescope neck and extending from the vicinity of said neck horizontally outwardly therefrom and a second portion, coupled to said first portion and disposed substantially parallel to the longitudinal axis of said neck, the vertical dimension of each of said portions being a small fraction of the diameter of said kinescope neck, said members disposed within said external fields of said horizontal and vertical coils, said first portions channelling the flux from said vertical coil external field to said second portions to form respective correcting magnetic fields between the upper members of said first and second field forming means and between the lower members of said first and second field forming means.

2. The arrangement defined in claim 1 wherein each of said first and second field formers comprises an upper field forming member disposed above said horizontal axis and located between said horizontal axis and said upper magnetically permeable member, and a lower field forming member disposed below said horizontal axis and located between said horizontal axis and said lower magnetically permeable member, each of said field forming members having an elongated first portion disposed substantially perpendicular to the longitudinal axis of said kinescope neck and a second portion coupled to said first portion and disposed substantially parallel to said kinescope neck, the second portions of said field forming members being disposed more remotely from said kinescope vertical axis than said second portions of said magnetically permeable members.

3. The arrangement defined in claim 2 wherein each of said first and second field forming means comprises an additional field forming member disposed above said kinescope horizontal axis and between said horizontal axis and said additional upper field forming member, and an additional field forming member disposed below said kinescope horizontal axis and between said horizontal axis and said additional lower field forming member, each of said additional field forming members having an elongated first portion disposed substantially perpendicular to the longitudinal axis of said kinescope neck and a second portion coupled to said first portion and disposed substantially parallel to said kinescope axis, the second portions of said additional field forming members being disposed more remotely from said kinescope vertical axis than said second portions of said first-named field forming members.

4. The arrangement defined in claim 3, further comprising an annular ring of magnetically nonpermeable material mounted on said kinescope neck independent of the mounting of said yoke thereon, said ring having apertures formed therein for receiving said second portions of said magnetically permeable members, said second portions of said first-named field forming members and said second portions of said additional field forming members.

5. The arrangement defined in claim 1 wherein said elongated first portions extend outwardly at least to the perimeter of the rear of said permeable core.

6. The arrangement defined in claim 1, wherein the vertical dimension of each of said portions is at least an order of magnitude less than the diameter of said kinescope neck.

7. The arrangement defined in claim 1, wherein said first and second field forming means are mounted on said kinescope neck independent of the mounting of said yoke thereon.

8. The arrangement defined in claim 1, further comprising an annular ring of magnetically nonpermeable material mounted on said kinescope neck independent of the mounting of said yoke thereon and providing support for said magnetically permeable members.

9. The arrangement defined in claim 8, wherein said annular ring has apertures formed therein for receiving said second portions of said magnetically permeable members.

* * * * *